US005582023A

United States Patent [19]

O'Neal

[11] Patent Number: 5,582,023

[45] Date of Patent: Dec. 10, 1996

[54] REFRIGERANT RECOVERY SYSTEM WITH AUTOMATIC AIR PURGE

[76] Inventor: Andrew O'Neal, 18517 8th Ave. NE., Seattle, Wash. 98155

[21] Appl. No.: 387,340

[22] Filed: Feb. 13, 1995

Related U.S. Application Data

[63] Continuation-in-part of Ser. No. 154,537, Nov. 19, 1993, Pat. No. 5,400,613.

[51] Int. Cl.[6] ..... F25B 43/04

[52] U.S. Cl. ..... 62/195; 62/475; 62/292

[58] Field of Search ..... 62/77, 85, 149, 62/195, 292, 475

[56] References Cited

U.S. PATENT DOCUMENTS

| | | | |
|---|---|---|---|
| 4,766,733 | 8/1988 | Scuderi | 62/77 |
| 4,862,702 | 11/1989 | O'Neal | 62/196.4 |
| 4,981,020 | 1/1991 | Scuderi | 62/77 |
| 5,005,369 | 4/1991 | Manz | 62/195 |
| 5,063,749 | 11/1991 | Manz | 62/149 |
| 5,181,391 | 1/1993 | Manz | 62/195 |
| 5,193,351 | 3/1993 | Laukhuf et al. | 62/195 |
| 5,195,333 | 4/1993 | Van Steenburgh, Jr. | 62/292 |
| 5,291,743 | 4/1994 | Van Steenburgh, Jr. | 62/149 |

*Primary Examiner*—John M. Sollecito

[57] ABSTRACT

A portable apparatus for recovering refrigerant from a refrigeration system and delivering the refrigerant to a refrigerant storage tank. The recovery is automatically terminated when the liquid refrigerant occupies 80% of the volume of the recovery tank. The apparatus includes a liquid sensing thermistor that is in contact with the entering refrigerant to the recovery machine. When liquid is detected, it is routed directly to the recovery tank. Gaseous refrigerant and any non-condensable gases from the top of the recovery tank are directed to the suction of a compressor then to a condenser and to a purge vessel that functions as a receiver. When the entering refrigerant is in a gaseous phase, it is routed to the suction of the compressor. A second liquid sensing thermistor is in contact with the gaseous refrigerant from the top of the recovery tank and if liquid is detected the recovery process is terminated. A liquid sensing device near the bottom of the purge vessel actuates a solenoid valve to return the condensed liquid to the liquid inlet of the recovery tank. A cooling coil at the interior top of the purge vessel also condenses refrigerant. When non-condensable gases accumulate around the coil, there is less latent heat input to the coil and the suction line temperature drops. A temperature control with the sensing bulb at the suction line at a preset point actuates a solenoid valve in a line from the top of the purge vessel to purge the non-condensable gas through a small orifice to the atmosphere.

12 Claims, 1 Drawing Sheet

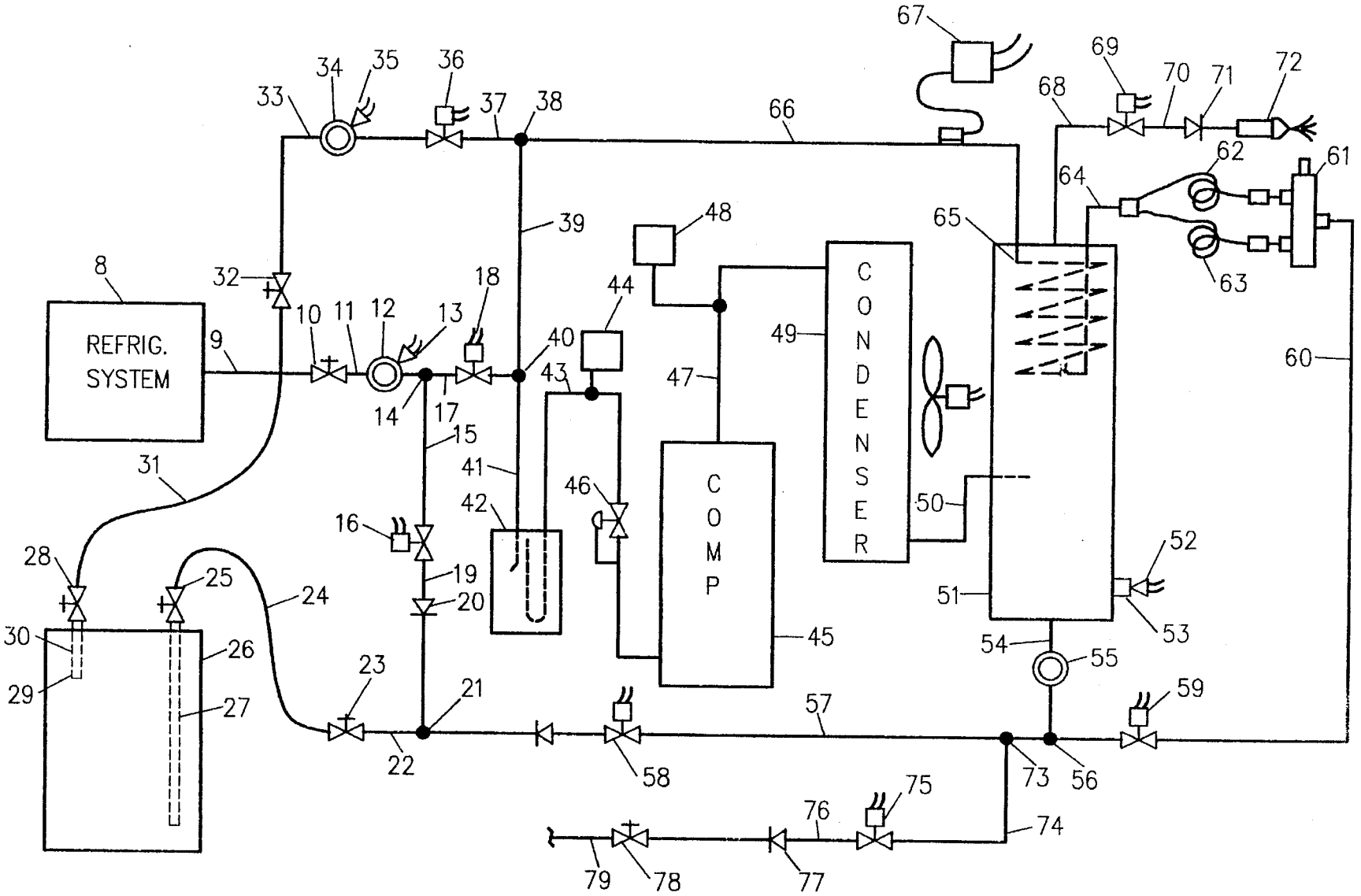
CONDENSER
COMP
REFRIG. SYSTEM

REFRIGERANT RECOVERY SYSTEM WITH AUTOMATIC AIR PURGE

RELATED U.S. APPLICATION DATA

This application is a continuation in part of my application Ser. No. 08/154,537 filed Nov. 19, 1993 now issued as U.S. Pat. No. 5,400,613.

TECHNICAL FIELD

The present invention relates to the recovery of refrigerant from a refrigeration system to a recovery storage tank and the separation and venting to the atmosphere of noncondensable gases. Also disclosed is a method of releasing noncondensable gases from recovery storage tanks and the stopping of the recovery process when the storage tank or tanks are 80% full of liquid refrigerant.

BACKGROUND OF THE INVENTION

Because of concerns about the release of refrigerant gases to the atmosphere and the prohibition of knowingly venting refrigerants, especially ozone depleting refrigerants, there is a need for efficient automatic purging of noncondensable gases with only de-minimis release of refrigerant. My application accomplishes this on operating refrigeration systems. The disclosure of this is incorporated by reference. In a refrigeration system, it is well understood that air and noncondensable gases (herein after air refers to both air and noncondensable gases) can produce high head pressures and cause the compressor to operate at higher than normal temperatures. Air will react with the refrigerant and oil at the head of the compressor and cause decomposition and the formation of acids (hydrofluoric and hydrocloric.) Air can be trapped in the upper space of the receiver or can circulate through the system, induced by the velocity of the refrigerant. In the evaporator or the condenser, air can interfere with the heat exchange process.

Air can be present in a system because of incomplete evacuation after-pressure testing with nitrogen, by leakage of air into the system that operates under vacuum and by seepage of air into the system when opened for the repair or replacement of a component. In most cases, the customary method to remove air is to manually purge at the location where the system was opened or to pump the system down, shut off the compressor and manually purge from the top of the condenser. This is wasteful as refrigerant is released.

When refrigerant is recovered from a system, usually air can also be recovered and with present recovery machines it is trapped in the recovery tank. The partial pressure of the air adds to the saturation pressure of the refrigerant. This increased pressure slows down the recovery process and has to be manually purged from the top of the recovery tank.

Refrigerant reclaim and recovery systems that have methods for removing air are shown in U.S. Pat. Nos. 5,005,369 and 5,063,749 of Manz and U.S. Pat. Nos. 5,195,333 and 5,291,743 of Van Steenburgh,Jr. Other U.S. Patents for refrigerant recovery are shown in U.S. Pat. Nos. 4,766,733 and 4,981,020 of Scuderi.

It is necessary that the liquid level in recovery tanks be kept at a safe level, generally 80% full so that dangerous hydrostatic pressure can not result if the liquid refrigerant becomes warmer. The usual method of preventing overfilling of a recovery tank is to employ a liquid level float switch or an electronic weighing device that electrically connects with the circuit of the recovery machine to stop the recovery process.

SUMMARY OF THE INVENTION

An apparatus for recovering refrigerant from a refrigeration system and delivering the refrigerant to a recovery storage tank. Also disclosed is means for automatically separating and discharging air to the atmosphere. The apparatus includes a liquid sensing glass enclosed thermistor of the type shown in my previous U.S. Pat. No. 4,862,702 that is in contact with the entering refrigerant to the recovery machine. When liquid is detected, a solid state circuit actuates a electrical relay to energize a first solenoid valve that routes the liquid directly to the recovery tank. Gaseous refrigerant and any entrained air is directed through a third solenoid valve electrically in parallel with the first solenoid valve from the top of the recovery tank to the suction of a compressor thereby lowering the saturation temperature of the liquid in the recovery tank which induces a faster flow of liquid to the recovery tank. When the entering refrigerant is in a gaseous phase, the solid state circuit deactivates the relay thereby opening the circuit to the first and third solenoid valves and closing a circuit to a second solenoid valve which directs the flow to the compressor. The compressed gas is condensed by a air cooled condenser and flows to a vertical purge vessel which functions as a receiver. A liquid level sensing thermistor near the bottom of the purge vessel activates a fourth solenoid valve in a liquid line exiting the bottom of the purge vessel to direct condensed liquid to the recovery tank.

The combination of the above functions assures that no air or noncondensable gases remain in the recovery tank and no manual purging from the recovery tank is necessary. The air is directed to the purge vessel to be automatically purged. When the partial pressure of air raises the pressure in the purge vessel to a pre-selected point above the normal condensing pressure, the recovery process is interrupted and a fifth solenoid valve is energized in a line that tees off upstream from the fourth solenoid valve in the liquid line that exits from the bottom of the purge vessel to feed refrigerant to selective capillary tubes depending on the type of refrigerant being handled to a a cooling coil located in the upper space of the purge vessel. The outlet of the cooling coil is connected to the suction line to the compressor. The sizing of the coil is of greater capacity than that of the capillary tube when refrigerant gas from the condenser is being condensed so there is high superheat at the outlet of the coil. When air, having a lower density than the refrigerant gas, accumulates in the upper space of the purge vessel and collects around the cooling coil, there is less contact of condensing gas with the cooling coil and the superheat becomes less because of less latent heat input to the coil. Therefore the temperature at the suction line becomes lower. A temperature control having a sensor at the suction line actuates a sixth solenoid valve when the temperature drops to a pre-selected set point to purge air through a orifice to the atmosphere. As air leaves the purge vessel, more coil surface is exposed to the condensing gas and the suction temperature rises causing the temperature control to shut off the purging solenoid valve. When the pressure drops to a pre-selected point because of less air in the purge vessel, the purging process is terminated and the recovery process is again initiated. The recovery of refrigerant is stopped when all of the refrigerant in the system is recovered and the suction pressure at the compressor drops to just above atmospheric pressure or to a vacuum level mandated by the Environmental Protection Agency or other governing agency. Recovery will also be terminated when the level in the recovery tank or tanks become 80% full.

A novel feature of this invention is that the line for conducting gaseous refrigerant from the top of the recovery tank is extended into the recovery tank a pre-determined distance so that when the recovery tank is 80% full, liquid refrigerant will enter the extended tube and will be directed to the gaseous line to a suction accumulator and to the compressor. A liquid sensing thermistor in a fitting in a horizontal section of the line prior to the suction accumulator will sense liquid refrigerant and through a S.S. circuit + will activate a electrical relay to terminate the recovery process so that there will be sufficient internal space in the recovery tank so thermal expansion of liquid will not create excessive hydrostatic pressure. The extended tube that projects into the recovery tank has a bleed hole at the interior top of the tank so that air, being of less density than the refrigerant, will be released and conveyed through the compressor and the condenser to the purge vessel to be automatically purged to the atmosphere. Multiple recovery tanks can be also hooked up in series with the first tank by connecting the gas outlet of the first tank to the liquid inlet of the second tank and with the same hookup for additional tanks. The last tank has the gas outlet connected to the gaseous line that is connected to the suction accumulator and compressor. Therefore all recovery tanks will be 80% full and be vented of any air. This will eliminate having liquid level float switches in the recovery tanks or electronic weighing devices that have to be electrically connected to the control system of the recovery machine.

The purge system of this invention can be used on any operating or non-operating refrigeration system or any refrigerant handling system from which air or non-condensable gases are to be purged.

DESCRIPTION OF THE DRAWINGS

The figure shows a schematic drawing of the apparatus of the present invention. The refrigeration system or the refrigerant handling system is not shown in detail.

DETAILED DESCRIPTION OF THE INVENTION

The apparatus of the present invention is a refrigerant recovery machine that receives refrigerant from a refrigeration unit 8 that has liquid and gaseous refrigerant to be recovered and delivered to a recovery tank 26. From connecting line 9 and inlet valve 10, line 11 has a first sight glass fitting 12 having a first liquid level sensing thermistor 13 of the self heating type. Said thermistor being glass enclosed and in contact with the flow of the refrigerant. Changes of resistant of the thermistor in reaction to contact with the liquid phase or gaseous phase refrigerant actuates through a first solid state circuit and a single pole two throw relay that when liquid is present will close an electrical circuit to a first electrically operatable solenoid valve 16 and when gaseous refrigerant is present will open the circuit to the first solenoid valve and close a circuit to a second solenoid valve 18. Line 11 connects to a tee connection 14 that connects by line 15 to the first solenoid valve 16 and connects by line 17 to the second solenoid valve 18. When liquid is present, the flow is directed to the recovery tank 26 and when gaseous refrigerant is detected, the flow is directed to the condensing means as will be explained.

Liquid refrigerant flows from the first solenoid valve 16 to line 19 that has a check valve 20 and connects to the tee connection 21. Line 22 connects from the tee 21 to manual valve 23. Refrigerant duty hose 24 connects from valve 23 to inlet port valve 25 of recovery tank 26. Extension tube 27 connects from inlet port valve 25 and terminates near the interior bottom of the recovery tank 29.

A second outlet port valve 28 of recovery tank 26 has a extension tube 29 that projects into the receiver tank a distance so that when the recovery tank is 80% full, liquid will enter the extension tube 29, A bleed hole 30 at the extension tube near the interior top of the recovery tank permits any air or non-condensable gases to enter the extension tube 29. A refrigerant duty hose 31 connects from the outlet port valve 28 to a manual valve 32 which connects through line 33 to a second sight glass fitting 34 having a second liquid level sensing thermistor 35 which reacts to liquid to activate through a second solid state circuit and relay to interrupt the electrical supply to the recovery machine when the recovery tank is 80% full. Down stream from the second sight glass fitting 34 is a third solenoid valve 36 that is electricalin parallel with the first solenoid valve 16 so that when gaseous refrigerant is at the second sight glass fitting, a flow of gaseous refrigerant is established from the third solenoid valve 36 through line 37 to a tee connection 38 that connects through line 39 to tee connection 40 and line 41 to suction accumulator 42 and through suction line 43 to compressor 45 thereby lowering the saturation temperature of liquid refrigerant in the receiver tank 26 which induces a faster flow of liquid to the recovery tank. A low pressure control switch 44 is connected to line 43 to control the operation of the compressor 45, The low pressure control is ordinarily set to stop the compressor at 0 PSIG but can be adjusted to cut out at a vacuum level of typically 20" of mercury if the refrigeration unit is to be evacuated to a low level as when the refrigeration unit 8 is to be taken out of service and dismantled or when the refrigeration unit is to be charged with new or a different type of refrigerant. An outlet pressure regulating valve 46 is located in line 43 to limit the suction pressure at the compressor to a pre-selected maximum so that the compressor motor will not be overloaded by high pressure from said serviced refrigeration unit 8 when said serviced refrigeration system 8 is in operation.

The high pressure of the compressor 45 connects through line 47 to a air cooled condenser 49. A high pressure control 48 with single pole double throw contacts connects to line 47. The condensed gas flows from the condenser through line 50 into and at a midpoint location of a vertical purge vessel 51 that functions as a receiver. A third liquid sensing thermistor 52 at a fitting 53 located near the bottom of the purge vessel activates through a solid state circuit and relay a fourth solenoid valve 58 when condensed liquid in the said vessel rises to the level of the third thermistor 52. The fourth solenoid valve is connected from the bottom of the purge vessel 51 by line 54 that has a sight glass and through a tee connection 56 and by liquid line 57. The outlet of the fourth solenoid is connected through check valve 80 to tee connection 21 where the liquid intermingles with any flow of liquid from line 19 to enter the recovery tank 26. When the partial pressure of air raises the pressure in the purge vessel to a pre-selected pressure above the normal condensing pressure, high pressure control 48 will open the electrical circuit that controls the recovery process and closes a circuit to initiate a purging process whereby a fifth solenoid valve 59 is energized which receives liquid through line 54 from tee connection 56. A manual three way valve 61 is connected by line 60 from solenoid valve 59 and controls the feed of refrigerant to a first capillary tube assembly 62 or to a second capillary tube assembly 63 or to both depending on the density and heat removal capacity of the particular refrigerant feeding through the connecting inlet of cooling coil 65 located in the interior top of the purge vessel 51. The cooling coil outlet connects to suction line 66 that intersects at tee connection 38 to flow through suction accumulator 42, compressor 45, condenser 49 and purge vessel 51 to complete a continuous refrigeration cycle. When refrigerant gas is being condensed, there is high superheat and temperature at the cooling coil outlet. When air of lower density and having no latent heat displaces the refrigerant gas at the cooling coil, there will be lower heat input into the cooling coil and there will be lower superheat and temperature at the cooling outlet. A temperature control 67 having a sensor at the suction line 66 actuates a sixth solenoid valve 69 connected from the top of the purge vessel by line 68 When the temperature at the suction line drops to a pre-selected point so that air is purged from the purge vessel through purge solenoid valve 69 and connecting line 70 having a check valve 71, which prevents ambient air from being drawn into the apparatus when vacuum conditions occur therein, and through a purge fitting 72 with a replaceable orifice to the atmosphere. When air leaves the purge vessel it will be replaced by condensing gas so that when the discharge pressure drops to a pre-selected point because of less air in the purge vessel, high pressure control 48 will open the circuit that controls the purging process and close the opposite circuit to establish the recovery process again.

A manually operated momentary contact switch by the said solid state circuit relay bypasses the relay contacts so that the balance of liquid refrigerant in the purge vessel 51 can be released through solenoid valve 58 to the recovery tank at the end of the described recovery process. When the presence of gaseous refrigerant appears at the sight glass 55, the momentary contact switch can be released so that there is no possibility of any remnant of air entering the recovery tank.

A lockout relay activated by the said second solid state circuit and relay prevents the restart of the recovery process when the second liquid level thermistor 35 reacts to liquid at the second sight glass fitting 34.

When it is desired to purge an operating refrigeration system, line 9 for incoming refrigerant is connected to a desirable purge point, not shown, generally a purge valve connected at the top of the receiver of the operating refrigeration system. A electrical two pole two throw switch permits shifting from the activation of the fourth solenoid valve 58, to a seventh solenoid valve 75 which connects from a fourth tee connection 73 downstream from the sight glass 55 and located between the 4th solenoid valve 58 and the third tee connection 56, so that refrigerant condensed in the purge vessel 51 can be returned through a check valve 77 and hand operated valve 78 to the liquid line, not shown, of the operating refrigeration system.

What is claimed is:

1. An apparatus for removing refrigerant from a refrigeration system and delivering the refrigerant to a recovery tank wherein any non-condensable gases recovered from the refrigeration system is automatically purged to the atmosphere, comprising:

means for transferring refrigerant from a refrigeration system through a sight glass fitting having a liquid level sensing thermistor in contact with the refrigerant that activates, when the entering refrigerant is in a liquid phase, to energize a first electrically operatable solenoid valve, that is located downstream from the slight glass fitting and a first tee junction, to deliver refrigerant through a first check valve and second tee junction to a inlet port of a receiving recovery tank or when the entering refrigerant is in a gaseous phase, the liquid level sensing thermistor will cause the first solenoid valve to be de-energized and opposing contacts to energize a second solenoid valve thereby permitting flow of gaseous refrigerant from the first tee junction to a suction conduit that connects with a condensing means, means to vent gaseous refrigerant and any entrained non-condensable gases from the top of the recovery tank to a second sight glass fitting with a second liquid level sensing thermistor and through a third solenoid valve connected electrically in parallel with the first solenoid valve to deliver gaseous refrigerant and any non-condensable gas to the said suction conduit;

means for connecting the said condensing means to a purge vessel that acts as a receiver for high pressure condensed refrigerant and for conveying the accumulated refrigerant from the bottom of the purge vessel through a conduit having a sight glass to a third tee junction, to a fourth solenoid valve and to the said second tee junction that connects to an inlet port of the recovery tank;

means for conveying refrigerant from a connection at the third tee junction to a fifth solenoid valve controlled by a high pressure switch which activates said fifth solenoid valve at a pre-selected pressure above the normal condensing pressure which thereby indicates the presence of non-condensable gas in the purge vessel, the outlet of the fifth solenoid valve connecting to a manual three way valve that feeds liquid selectively through two capillary tube assemblies to a cooling coil disposed in the top interior of the purge vessel, an outlet of the cooling coil connecting to the suction conduit to the condensing means forming a complete refrigeration cycle;

means for purging non-condensable gas from the purge vessel when a temperature sensing means, having a sensing bulb at the suction line outlet of the cooling coil, detects a lowered temperature resulting from the presence of non-condensable gas at the cooling coil effecting less latent heat load at the cooling coil, said temperature sensing means thereby actuating at a pre-selected point, a sixth solenoid valve connecting from the top of the purge vessel thereby causing non-condensable gas to be released to the atmosphere through a purge fitting having a replaceable orifice.

2. The apparatus of claim 1, wherein the condensing means includes a suction accumulator, a compressor, and an air cooled condenser connected to a midpoint of said purge vessel.

3. The apparatus of claim 1, wherein the means for conveying condensed refrigerant from the bottom of the purge vessel through the fourth solenoid valve is activated by a liquid level sensing thermistor located in a fitting at the lower portion of the purge vessel whereas contact with the liquid refrigerant will cause a solid state circuit and relay to energize the fourth solenoid valve.

4. The apparatus of claim 1 wherein said inlet port of the recovery tank has a first extension conduit that extends into the interior of the recovery tank to a point near the bottom of the recovery tank.

5. The apparatus of claim 1, wherein said means to vent gaseous refrigerant and any entrained non-condensable gases including air from the top of the recovery tank includes an outlet port having a extension conduit that extends into the interior of the recovery tank a distance that when the liquid occupies 80% of the volume of said tank, liquid refrigerant will enter the open end of the extension conduit and be conveyed to the said second sight glass fitting having the second liquid level thermistor that will activate to terminate the recovery process.

6. The apparatus of claim 5, wherein the said extension conduit that extends into the interior of of the recovery tank a distance has a bleed hole in the extension conduit near the interior top of the recovery tank for the purpose of permitting any accumulated non-condensable gas to be drawn into the extension conduit.

7. The apparatus of claim 2 wherein an outlet pressure regulating valve is located prior to the inlet of the said compressor and that is pre-adjusted for a maximum pressure so that the compressor motor does not overload.

8. The apparatus of claim 3 wherein a check valve is located at the outlet of the said fourth solenoid valve to prevent reverse flow into the bottom of the said purge vessel.

9. The apparatus of claim 7 wherein the said outlet pressure regulating valve limits the maximum pressure at the inlet of the compressor so that gaseous refrigerant and non-condensable gases can be received from said refrigeration system when said refrigeration is in operation, thereby automatically purging any non-condensable gas or air therefrom to the atmosphere.

10. The apparatus of claim 9 wherein a seventh solenoid valve is connected from a fourth tee junction located down stream from the third tee junction, wherein said seventh solenoid valve thereby allows the accumulated liquid refrigerant in the purge vessel to be returned to the liquid line of the operating refrigeration system through a connecting conduit having a check valve and a shut off valve.

11. The apparatus of claim 9 wherein gaseous refrigerant and non-condensable gases are received from a non-operating refrigeration system.

12. The apparatus of claim 1 wherein a check valve is located downstream from the sixth solenoid valve to prevent ambient air from being drawn into the apparatus when vacuum conditions occur therein.

* * * * *